US006473587B2

(12) United States Patent
van Woerkens

(10) Patent No.: US 6,473,587 B2
(45) Date of Patent: Oct. 29, 2002

(54) MOVABLE CHARGE-METERING MEMBER FOR A SINGLE COMPONENT DEVELOPMENT SYSTEM

(75) Inventor: Paul van Woerkens, Helmond (NL)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/750,422

(22) Filed: Dec. 28, 2000

(65) Prior Publication Data

US 2002/0085862 A1 Jul. 4, 2002

(51) Int. Cl.[7] ..... G03G 15/08
(52) U.S. Cl. ..... 399/284
(58) Field of Search ..... 399/274, 284

(56) References Cited

U.S. PATENT DOCUMENTS 5,168,312 A * 12/1992 Aoto et al. ..... 399/284
5,289,237 A * 2/1994 Hashizume et al. ..... 399/284
5,761,588 A * 6/1998 Mikawa et al. ..... 399/274
5,765,080 A 6/1998 Bogoshian ..... 399/275
6,044,241 A 3/2000 Kumar et al. ..... 399/284
6,088,567 A 7/2000 Imes et al. ..... 399/284

* cited by examiner

*Primary Examiner*—William J. Royer
(74) *Attorney, Agent, or Firm*—Oliff & Berridge, PLC; Eugene Palazzo

(57) ABSTRACT

A single component development system of an image forming system includes a movable charge-metering member. The development system includes a motion-imparting system in cooperation with the charge-metering member for periodically shifting the charge-metering member to expose a fresh surface for charging and metering toner on a developer member. The motion-imparting system is indexed to expose a fresh surface for charging and metering of toner particles by rotating, shifting or translating the charge-metering member.

21 Claims, 5 Drawing Sheets

MOVABLE CHARGE-METERING MEMBER FOR A SINGLE COMPONENT DEVELOPMENT SYSTEM

BACKGROUND OF THE INVENTION

This invention relates to a development unit for use in an image forming system. Specifically, this invention relates to a development unit including a charge-metering member.

In conventional image forming systems, the image forming process includes charging a photoconductive image member to a substantially uniform potential to sensitize the surface thereof. A charged portion of the photoconductive surface is exposed at an exposure station to a light image of an original document to be reproduced.

Exposing an image of an original document as such at the exposure station records an electrostatic latent image of the original image onto the imaging member. The recorded latent image is subsequently developed using a development subsystem by bringing a charged dry or liquid developer material into contact with the latent image using a developer roll. The toned image is then transferred to paper or another print substrate and permanently fused to the substrate to form a "hardcopy" of the original image.

A commonly used development technique involves a single component developer material, comprised mainly of toner particles. In a typical single component development system, each toner particle has both magnetic properties (to allow the particles to be magnetically conveyed to the imaging member) and an electrostatic charge (to enable the particles to adhere to the imaging member). In such a system, the developer roll is in the form of a cylindrical sleeve which rotates about a stationary magnet assembly. The magnetized toner particles adhere to the rotating sleeve by the force of the stationary magnets with the sleeve.

In single component development, the particle of toner is charged by a charge-metering member. A charge-metering member is typically in continuous contact with the toner particles along one portion or longitude of the developer roll. The charge-metering member performs two simultaneous functions: it allows a uniform metered layer of toner to pass underneath, and uniformly charges the toner that is mechanically metered. That is, the action of the toner particles rubbing against the charge-metering member and each other while being metered by the charge-metering member induces a charge on the toner particles. The uniformity of the nip formed between the charge-metering member and the developer roll plays a significant role in creating a uniform charge and uniform layer of toner across the developer roll. The charged particles on the surface of the developer roll are advanced towards the imaging member, and then transferred onto the imaging member in image-wise configuration to form a developed toner image on the imaging member. The toner image is subsequently transferred and fused to the paper.

In the prior art, the charge-metering member typically comprises an angled, resilient straight edge blade urged against the surface of the developer roll along the length thereof. The blade consists of a metal substrate with an elastomeric coating, or an elastomeric pad disposed at the free end of the blade. The charge-metering blade is oriented so that the elastomeric portion of the blade contacts toner particles on the surface of the developer roll in order to smooth the layer of toner particles and induce a charge therein.

A significant disadvantage to conventional charge-metering blades is that they deteriorate rather quickly.

Particularly, the surface of the blade that contacts the toner particles tends to wear down over time. As the charge-metering member is responsible for creating a uniform layer of toner and a uniform charge of toner across the developer roll, a deteriorated or worn charge-metering blade compromises print quality. A smooth contact surface on the charge-metering member is necessary to promote an even layer of toner and an even charge of the toner particles. When a charge-metering member wears out, indicated by degradation in the quality of the final image, it is necessary for a customer to replace it with a new charge-metering member. Often, this involves replacing a number of system elements that are collectively provided in a Customer Replaceable Unit (CRU). When a charge-metering member wears out, the entire CRU must be replaced, which is an expensive and time-consuming process. In a typical single component development system, the charge-metering blade deteriorates and is replaced after between about 12,000 and 15,000 copies.

SUMMARY OF THE INVENTION

The present invention provides a single-component development unit having a charge-metering member and a motion-imparting system in cooperation with the charge-metering member for periodically shifting the charge-metering member to expose a fresh surface for charging and metering toner on a developer member. After a certain print interval, the motion-imparting system automatically replaces a worn charge-metering surface with a new and unworn surface by shifting the charge-metering member. The present invention extends the life of the charge-metering member and the development unit as a whole. In addition, the present invention ensures that a smooth surface is continually used to charge and meter the toner. Consequently, the quality of a final image is significantly improved for an image forming process that utilizes the teachings of the present invention.

According to one aspect of the present invention, the developer unit comprises a housing, a developer member, and a rotatable charge-metering member that cooperates with the developer member to charge said toner particles on the developer member and to regulate a thickness of a layer of toner particles on the developer member.

According to another aspect, the charge-metering member is a cylindrical roll, and a motion-imparting system is designed to rotate the cylindrical roll after a predetermined time period to expose a fresh charge-metering surface.

According to another aspect, the charge-metering member comprises an endless belt, and a motion-imparting system is designed to advance the belt after a predetermined time period to expose a fresh charge-metering surface.

According to still another aspect, the charge-metering member comprises a rectangular blade, and a motion-imparting system is designed to shift the rectangular member to present a fresh charge-metering surface.

DETAILED DESCRIPTION OF PREFERRED EMBODIMENTS

The present invention provides an improved charge-metering member in the developer unit of an image forming system. While the present invention will be described in connection with illustrative embodiments of the inventions, it will be understood that the description is not intended to limit the invention to the described embodiments. As used herein, "charge-metering member" refers to any component suitable for use in an image forming system that simultaneously regulates and charges a layer of toner particles. T he charge-metering member generally comprises a metal substrate and a pliable portion such as plastic, silicon or even a pliable metal. The pliable portion is the area of contact with the toner particles, and has properties sufficient to both meter the layer of toner particles and charge the toner particles.

Figure 1:
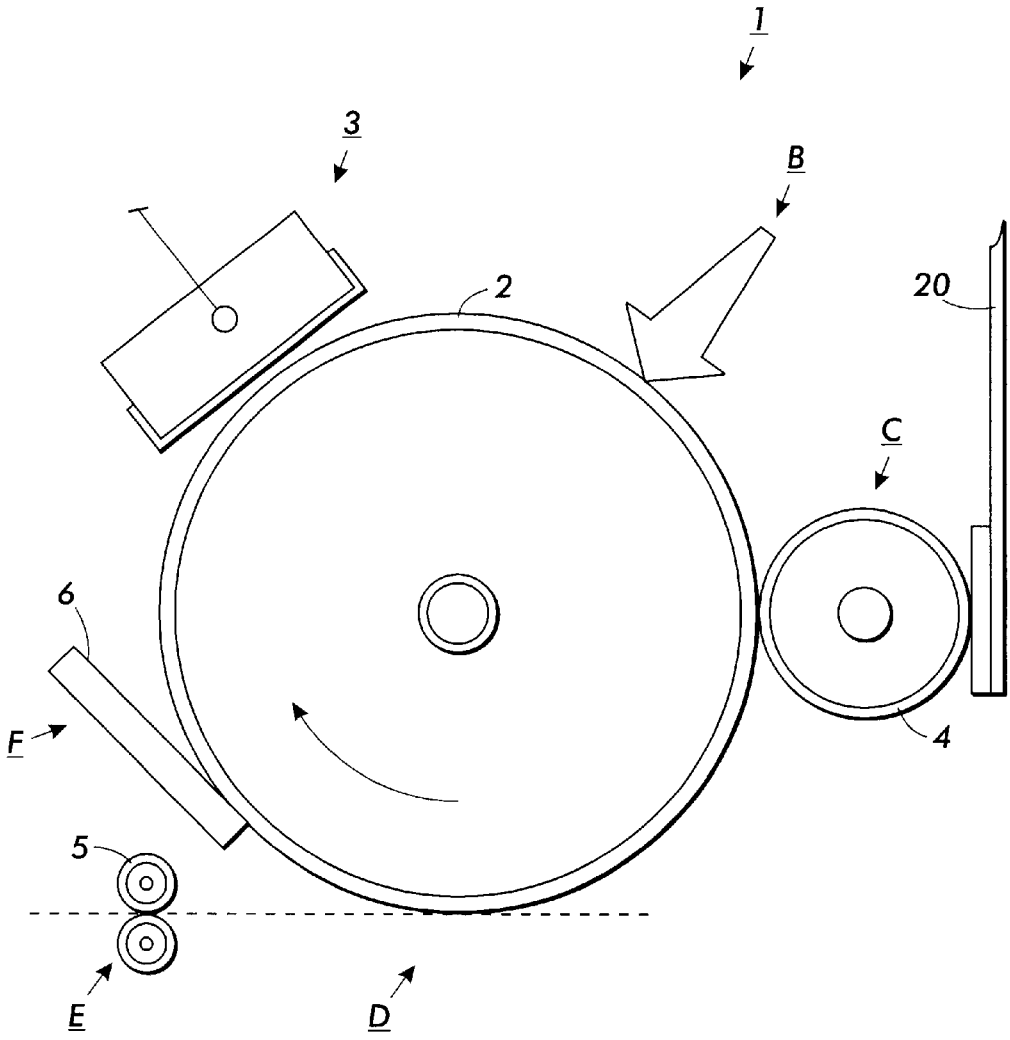
FIG. 1 (PRIOR ART)
FIG. 1 illustrates an image forming system suitable for employing the chargemetering member of the present invention.

FIG. 1 illustrates a typical image forming system 1 in which the invention is implemented. The image forming system may be an ionographic, electrographic, electrophotographic, or other similar system that is adapted to capture, store, form, produce and/or reproduce image data associated with a particular object, such as a document. The imaging cycle of the image forming system begins with a photoconductive imaging member 2. The imaging member 2 rotates in the direction of the arrow, and is charged by a charging device 3. The charging portion of the imaging member 2 is then rotated to an exposing station B where either a light lens system or a raster optical scanner forms a latent image on the imaging member 2. The latent image corresponds to an image of a document positioned on a platen (not shown) or to outpput which is sent to the raster output scanner.

The portion of the imaging member 2 bearing the latent image is then rotated to the developer unit C where the latent image is developed by the application of toner particles using a magnetic developer roll 4. In the case of a single-component development system, toner from a supply chamber is applied to the rotating developer roll, which then conveys the toner to a development zone adjacent the latent image recorded on imaging member 2. The details of the operation of developer unit C will be described in more detail below.

The developed image on the imaging member 2 is then rotated to a near vertical transfer point at transfer station D where the toner image is transferred to a copy sheet fed along a copy sheet or substrate path. The copy sheet substrate with the transferred toner image is then directed to a fuser station E where a heated fuser roll 5 and pressure roll rotate to heat, fuse and fix the toned image onto the copy sheet substrate. The copy sheet substrate then, as is well known, may be selectively transported to an output tray (not shown) or to another post fusing operation.

Figure 2:
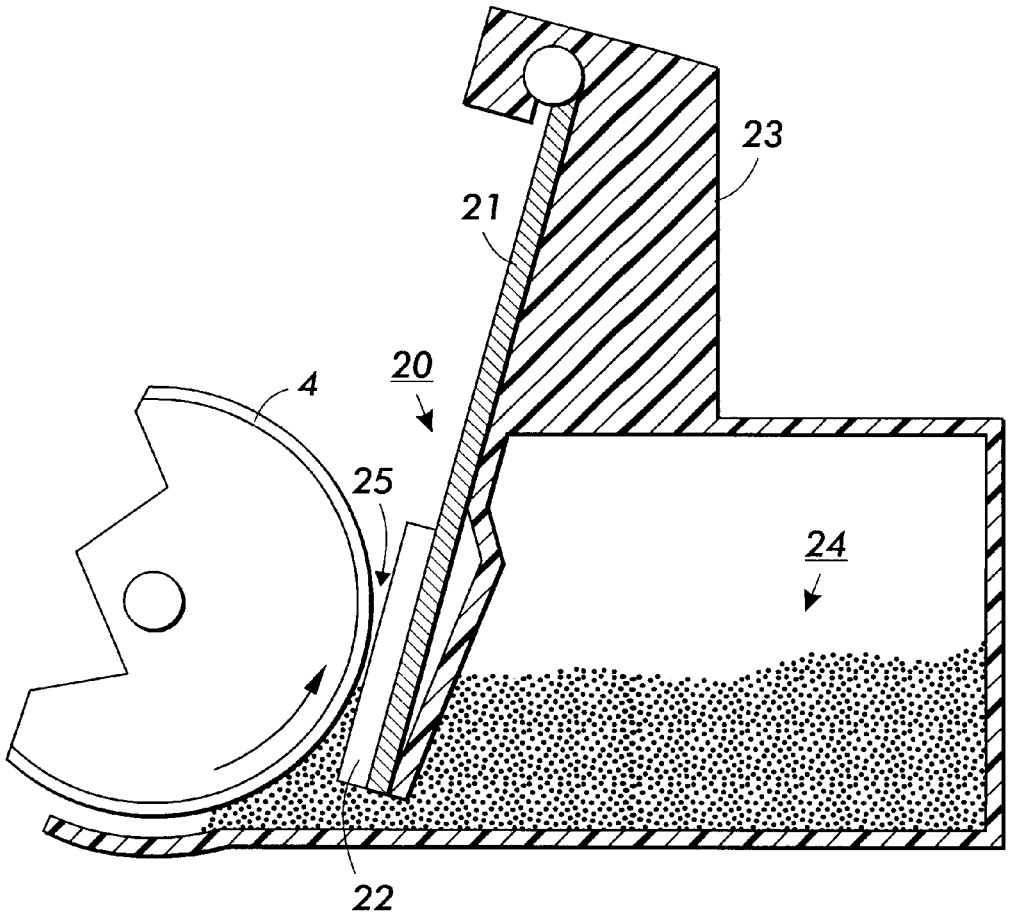
FIG. 2 (PRIOR ART)
FIG. 2 illustrates a charge-metering assembly of the prior art.

The portion of the imaging member 2 from which the developed toned image was transferred is then advanced to a cleaning station F where residual toner and residual charge on the imaging member 2 are removed by for example a blade 6. The imaging cycle of the imaging forming system 1 using the imaging member 2 can then be repeated for another image as the clean portion of the imaging member 2 again comes under the charging device FIG. 2 illustrates a conventional charge-metering member assembly contained within a developer unit housing 23. The conventional charge-metering member forms a straight edge blade, and will be referred to as a "charge-metering blade" for purposes of simplicity. The charge-metering blade 20 includes a spring steel strip 21 with an elastomeric strip 22 bonded thereto. The spring steel strip 21 is connected to the developer unit housing 23. A supply of toner particles 24 is contained within the developer unit housing 23. A portion of the elastomeric strip 22 comprises a charge-metering surface of the blade. The charge-metering surface positioned adjacent to the magnetic developer roll 4 to form a nip 25 through which the toner particles pass as the developer roll 4 rotates. Toner particles 24 are applied to the periphery of the developer roll as it rotates past the supply. The toner particles 24 are subsequently metered and charged by the charge-metering blade 20 when they are brought into contact with the elastomeric strip 22 of the charge-metering blade 20. As shown, only a small portion of elastomeric strip 22 contacts the toner particles. When this portion wears out, an irregular layer of toner and an uneven charge results. Wear on the blade is inevitable, in that the blade is made from a material that does not damage the periphery of the developer roll. The area of the blade that contacts the developer roll must be made of a non-abrasive material, such as silicone plastic, which may wear rapidly. The developer roll 4 comprises any element suitable for conveying toner particles from a toner supply to an imaging member and for applying the toner particles to the periphery of an imaging member. Generally, the developer roll is magnetic, so that magnetically charged toner particles adhere to the surface of the developer roll.

A deterioration of the charge-metering member leads to a non-uniform toner layer and/or a non-uniform charge, which causes streaks and irregularities in the final image. When a charge-metering member is worn out, indicated by a degradation in the quality of the final image, it is necessary for a customer to replace it with a new charge-metering member. As discussed, many of the elements and components of the image forming system may be provided in the form of a customer replaceable unit (CRU). The CRU is typically in the form of a cartridge, and includes consumable materials of the image forming system, such as toner, volume limiting components, such as a waste toner container, and life cycle limiting components, such as the photoreceptive imaging member, the charge-metering member, and the developer roll. When a charge-metering member wears out, the entire CRU must be replaced. Thus, the lifetime of the charge-metering member limits the lifetime of the CRU as a whole. In addition to being time-consuming, frequent replacement of a charge-metering member can be expensive. As the image forming system cannot operate without the charge-metering member, or the CRU, the usable operating time of the entire image forming system is limited by the charge-metering member as well.

Figure 3:
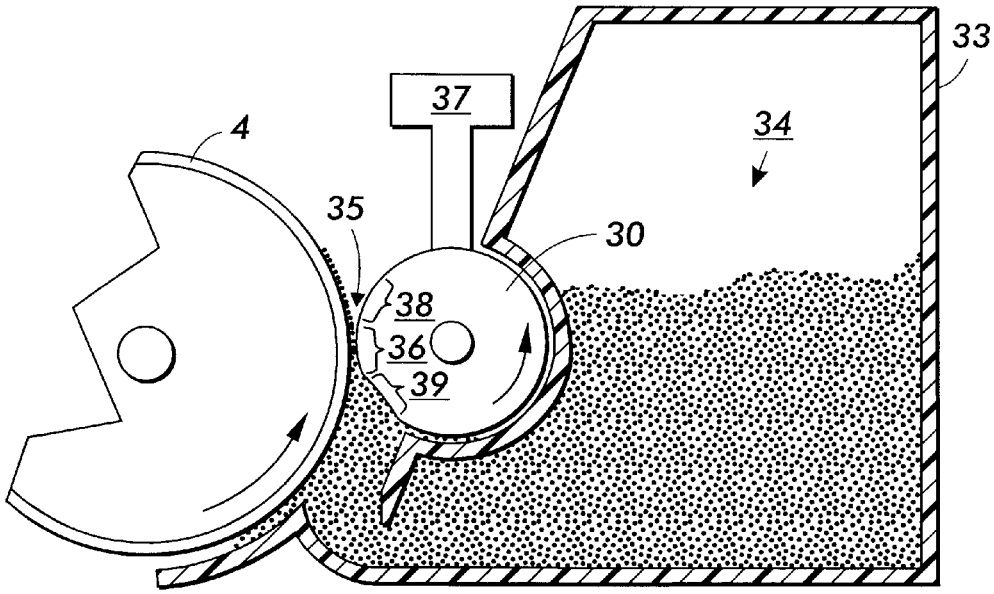
FIG. 3 illustrates one embodiment of the charge-metering assembly of the present invention in which the charge-metering member is a cylindrical roll.

The present invention, shown in FIG. 3, extends the usable life of a charge-metering member 30 by incorporating a motion-imparting system 37 designed to shift the charge-metering member 30 to expose a fresh surface for charging and metering toner. "Fresh surface" refers to an unused portion of a charge-metering member suitable for regulating and charging a layer of toner particles that has not been previously exposed to toner particles, and is unworn. During operation, the motion-imparting system 37 secures the charge-metering member 30 in a stationary position. In this stationary position, a fixed portion of the charge-metering member is in continuous contact with the toner particles.

Before the fixed portion wears down and deteriorates, the motion-imparting system automatically shifts the charge-metering member to expose a fresh, unworn surface for contacting the toner particles, without having to replace the entire charge-metering member. Thus, the usable surface area of the charge-metering member is increased. In this manner, the lifetime of the charge-metering member, as well as the Customer Replaceable Unit is extended significantly.

The motion-imparting system employed by the developer unit in the illustrated embodiments of the present invention may be any device capable of rotating, moving, advancing or translating a charge-metering member. The motion-imparting system secures a charge-metering member in a stationary position during the development process, and is indexed to shift the charge-metering member only after a predetermined number of images have been developed, or after a predetermined amount of time has elapsed. Suitable devices for the motion-imparting system include an electrical motor, gears connected to the developer roll or the imaging member or any other device capable of periodically rotating, moving, advancing, or translating the charge-metering member. Suitable devices for translating a charge-metering member are disclosed in, for example, U.S. Pat. No. 6,088,564, the contents of which are herein incorporated by reference.

According to one practice, the motion-imparting system is indexed to automatically shift the charge-metering member after a designated regular print interval, such as every 10,000 copies. Alternatively, the motion-imparting system may be shifted manually. With a manual index, the user is capable of shifting the charge-metering blade when considered necessary by the user. A manual-shifting index is beneficial when the charge-metering member wears out before the designated print interval for shifting the charge-metering member, and is capable of overriding an automatic motion imparting system.

The material that comprises the charge-metering member 30 of the present invention is similar to the material used in the charge-metering blades of the prior art, in order to provide proper charging and metering of the toner particles. Preferably, the charge-metering member is comprised of a metal substrate together with a pliable portion such as plastic, silicon or even a pliable metal. As the pliable portion is the area of contact with the toner particles, the pliable portion is resilient, durable, and has properties sufficient to both meter the layer of toner particles and charge the toner particles. The shape or configuration of the charge-metering member may be any shape or configuration that allows for cooperation with a motion-imparting system to shift, advance or rotate the charge-metering member.

According to one practice, as illustrated in FIG. 3, the charge-metering member is a cylindrical roll 30 comprised of a metal substrate (not shown) and a silicone plastic coating (not shown). The magnetic developer roll 4 and the charge-metering member 30 form a nip 35 through which the toner particles pass as the developer roll 4 rotates. Developer housing 33 contains a supply of toner particles 34 for application to the periphery of the developer roll 4. As toner passes through the nip 35, a contact portion 36 of the charge-metering member 30 simultaneously meters and charges the toner. During normal operation of the image forming system, the charge-metering member is held stationary and functions in a manner similar to the charge-metering blades of the prior art. In the illustrated embodiment of FIG. 3, used portion 39 shows a deterioration that results on the surface of the charge-metering member. In a previous step, the motion-imparting system 37 rotated the charge-metering member 30 to replace the deteriorated used portion 39 with contact portion 36 for charging and metering the toner particles. After a predetermined time period, the motion-imparting system 37 again rotates the cylindrical charge-metering roll 30 several degrees to expose a fresh surface 38 for charging and metering of the toner particles. Ideally, the charge-metering roll 30 rotates before the charge-metering surface deteriorates to the extent that print quality is compromised. As discussed, a standard charge-metering member wears out after about 12,000 to about 15,000 images are developed. Thus, it is desirable that the motion-imparting system 37 for rotating the charge-metering member 30 is indexed to expose a fresh surface after about 10,000 images. The number of degrees that the charge-metering member 30 rotates is sufficient for an unworn surface to be exposed to the developer roll. Those of ordinary skill will readily recognize the amount that the charge-metering member needs to be moved in order to expose a fresh surface.

Figure 4:
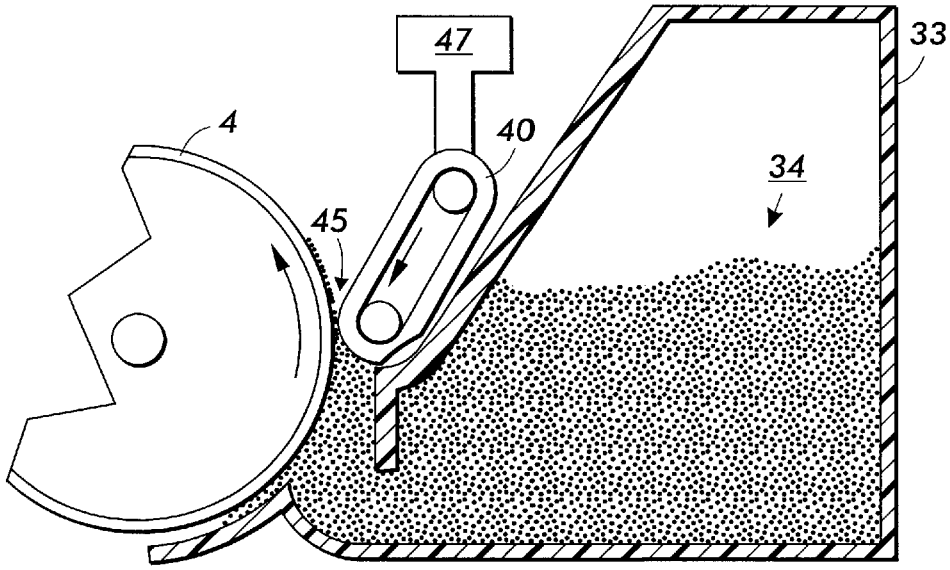
FIG. 4 illustrates an alternate embodiment of the charge-metering assembly of the present invention in which the charge-metering member is an endless belt.

In an alternate embodiment, as illustrated in FIG. 4, the charge-metering member comprises an endless belt 40. The contact surface of the belt is an elastomeric material, similar to the elastomeric material used in the prior art to charge and meter toner particles. Again, during standard operation of the image forming system, the charge-metering member is held stationary and forms a nip 45 between the developer roll 4 and the charge-metering member 40 to perform charging and metering of the toner particles. A motion-imparting system 47 advances the belt in a direction indicated by the arrow on the belt 40 after a predetermined time period to expose a fresh surface of the belt for contacting toner particles.

Figure 5:
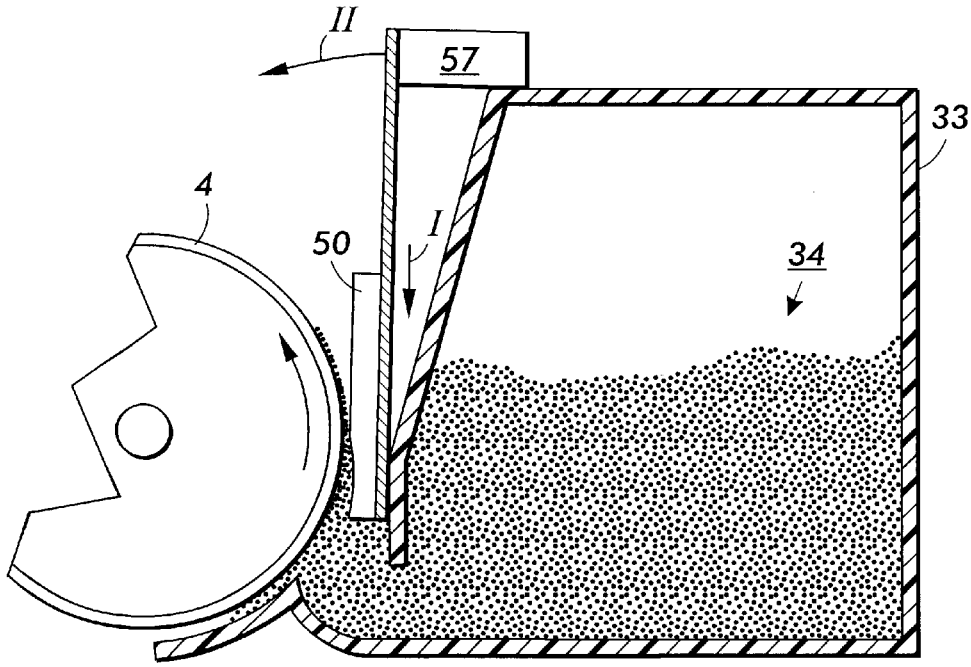
FIG. 5 illustrates an alternate embodiment of the charge-metering assembly of the present invention in which the charge-metering member is a rectangular blade.

In yet another embodiment, illustrated in FIG. 5, the charge-metering member is a straight edge blade 50, as described in the prior art. A motion-imparting system 57 is designed to shift the blade 50 in a linear direction to expose a new surface, such as in a downwards direction, illustrated by arrow I. Alternatively, the charge-metering member 50 pivots about a fixed point to expose a fresh and different surface for contacting the toner particles. In this case, the motion-imparting system 57 rotates the charge-metering member about the fixed point, in the direction indicated by arrow II. The charge-metering member may be shifted in any direction that brings a fresh, unused surface of the charge-metering member into contact with the toner particles.

In a preferred embodiment, the layer of toner particles to be applied to the latent image is between about 1000 to about 2000 microns. The charge-metering member is pressed against the surface of the developer roll, such that the charge-metering member forms a uniform layer of toner particles having a thickness between about 1000 and about 2000 microns.

Notable advantages are attained through implementation of a charge-metering member according to the principles of the present invention. Most importantly, the present invention extends the life of a charge-metering member significantly. The present invention increases the usable surface area of the charge-metering member by periodically shifting the member after a specified print interval to expose a new and unused surface for charging and metering of the toner particles. In this manner, the charge-metering member can continue operation after a portion of the charge-metering member wears out. The charge-metering member requires replacement only after all possible surfaces have been utilized. The amount of time an image forming system can produce high-quality images without replacing parts is therefore extended as well.

As a result, the present invention provides reduced maintenance costs for an image forming system caused by replacement of the charge-metering member or the Customer Replaceable Unit. As a charge-metering member is replaced less frequently, implementation of the present invention also leads to a reduction in the time that the image forming system is not operational. Thus, the image forming system is capable of producing a larger number of images within a given time period.

In addition to extending the lifetime of a charge-metering member, the present invention provides improved print quality. The charge-metering member continually provides a fresh contact surface for the toner particles, ensuring consistently adequate charging and metering of the toner. This results in improved solid area density in printed images, a reduction in irregularities, prevents inadequate application of toner to a latent image. By automatically indexing the charge-metering member to shift before print quality is compromised by a ragged and uneven charge-metering surface, a high-quality image is produced at all times.

While the present invention has been described with reference to various embodiments, those skilled in the art will appreciate that various modifications and variations may be made without departing from the scope of the invention. Accordingly, it is intended to include all such variations, alternatives and modifications in the appended claims.

What is claimed is:

1. In an image forming system, a developer unit for developing a latent image with toner particles, said developer unit comprising:

a housing defining a chamber for storing a supply of toner particles therein, a developer member for applying the toner particles to an imaging member to develop the latent image; and a rotatable charge-metering member cooperating with said developer member to charge said toner particles on the developer member and to regulate a thickness of a layer of toner particles on the developer member, wherein the charge-metering member comprises an endless belt.

2. The developer unit of claim 1, further comprising a rotation-imparting system for rotating said charge-metering member.

3. The developer unit of claim 2, wherein the rotation-imparting system comprises a indexing element for rotating the charge-metering member after a predetermined time period.

4. The developer unit of claim 3, wherein the predetermined time period is established by the number of latent images that are developed.

5. The developer unit of claim 2, wherein the rotation-imparting system rotates the charge-metering member by less than one complete revolution.

6. The developer unit of claim 1, wherein the charge-metering member comprises a metal substrate having a polymer coating thereon.

7. The developer unit of claim 1, wherein the charge-metering member is stationary during development of the latent image.

8. The developer unit of claim 1, wherein a first portion of the charge-metering member is in contact with the toner particles on the developer member, and a rotation-imparting system rotates the charge-metering member to expose a second, different portion of the charge-metering member to the toner particles.

9. In an image forming system, a developer unit for developing a latent image with toner particles, said developer unit comprising a housing defining a chamber for storing a supply of toner particles therein, a developer member for applying the toner particles to an imaging member, a charge-metering member comprising a blade having a straight edge cooperating with said developer member, wherein a first portion of the charge-metering member contacts the toner particles in order to charge the toner particles and to regulate a thickness of a layer of toner particles on said developer member; and a motion-imparting system for shifting said charge-metering member in a lateral direction to expose a second, different portion of the charge-metering member to the toner particles when said developer member is stationary.

10. The developer unit of claim 9, wherein the second, different surface comprises a non-toner particle exposed surface.

11. The developer unit of claim 9, wherein the charge-metering member is stationary during development of the latent image.

12. The developer unit of claim 9, wherein the motion-imparting system is indexed to shift the charge-metering member after a predetermined number of latent images are developed.

13. The developer unit of claim 9, wherein the motion-imparting system extends the lifetime of the charge-metering member.

14. In an image forming process, a method of developing a latent image with toner particles comprising the steps of:

storing a supply of toner particles in a housing;

advancing said toner particles on a surface of a developer member from the housing towards the latent image;

regulating a thickness of a layer of toner particles on the surface of the developer member with a first portion of a charge-metering member, wherein the charge-metering member comprises a blade having a straight edge cooperating with said developer member; and laterally shifting said charge-metering member to expose a second, different portion of the charge-metering member to the toner particles.

15. The method of claim 14, wherein said charge-metering member induces a charge in the toner particles.

16. The method of claim 14, wherein the charge-metering member is stationary during said step of regulating a thickness of a layer of toner particles.

17. The method of claim 16, wherein the charge-metering member is moved after a predetermnined number of latent images have been developed.

18. In an image forming process, a method of developing a latent image with toner particles comprising the steps of:

storing a supply of toner particles in a housing;

advancing said toner particles on a surface of a developer member from the housing towards the latent image;

regulating a thickness of a layer of toner particles on the surface of the developer member with a first portion of a charge-metering member, wherein the charge-metering member comprises an endless belt; and rotating said charge-metering member to expose a second, different portion of the charge-metering member to the toner particles.

19. The method of claim 18, wherein said charge-metering member induces a charge in the toner particles.

20. The method of claim 18, wherein the charge-metering member is stationary during said step of regulating a thickness of a layer of toner particles.

21. The method of claim 20, wherein the charge-metering member is rotated after a predetermined number of patent images have been developed.

* * * * *